United States Patent [19]

Zernig et al.

[11] 3,952,368

[45] Apr. 27, 1976

[54] HINGES

[76] Inventors: Ernst Zernig, Muhlenweg, D-5870 Hemer; Manfred Rüther, Friedhofsweg 13, D-5992 Nachrodt, both of Germany

[22] Filed: Jan. 9, 1975

[21] Appl. No.: 539,829

[30] Foreign Application Priority Data

| | | |
|---|---|---|
| Jan. 16, 1974 | Germany | 2401915 |
| Feb. 6, 1974 | Germany | 2405604 |
| Apr. 2, 1974 | Germany | 2415999 |

[52] U.S. Cl. ..... 16/163; 16/145; 16/166; 16/180; 16/190; 16/182

[51] Int. Cl.[2] ..... E05D 3/06; E05D 15/52

[58] Field of Search ..... 16/180, 190, 182, 164, 16/163, 145, 146, 139, 142, 166, 173, 183, DIG. 17

[56] References Cited

UNITED STATES PATENTS

| | | | |
|---|---|---|---|
| 3,203,031 | 8/1965 | Youngdale et al. | 16/145 |
| 3,590,420 | 7/1971 | Salice | 16/164 |
| 3,673,635 | 7/1972 | Cencioni | 16/163 |
| 3,864,786 | 2/1975 | Salice | 16/163 |

*Primary Examiner*—Geo. V. Larkin

[57] ABSTRACT

A scissors type hinge having crossed pivotably joined hinge arms, one of which is pivotably mounted on a fixing bracket and the other to a guide lever. The guide lever is pivotably mounted on the fixing bracket and spring means urge the hinge away from dead center so as to be fully open or fully closed, thereby achieving a latch effect.

34 Claims, 20 Drawing Figures

Fig. 2
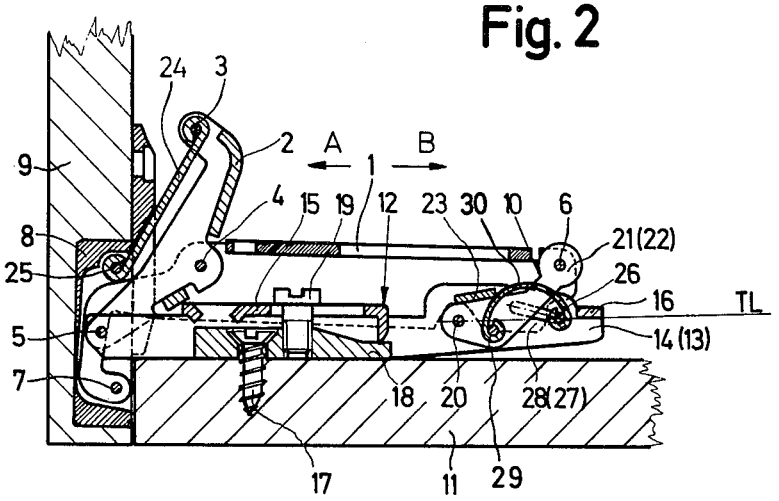
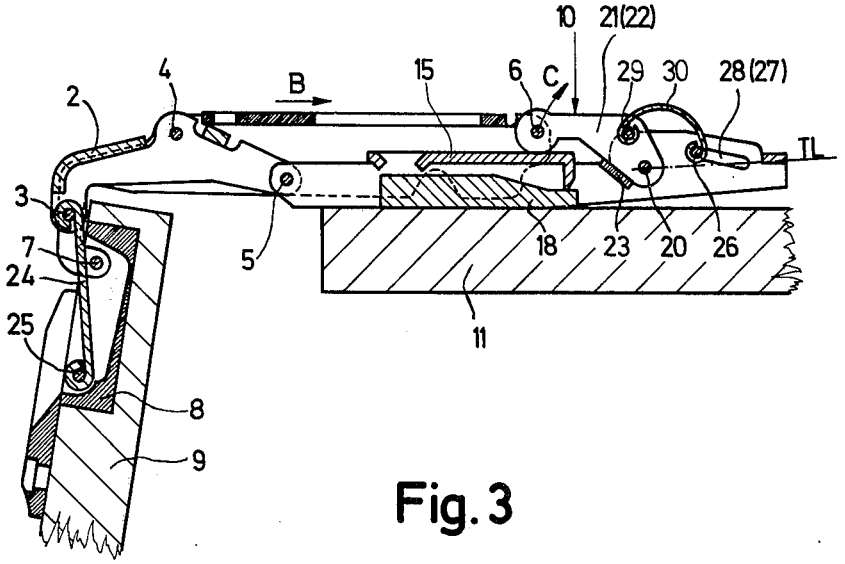
Fig. 3

127
136
137
135
140
133
131
138
139
134
132
125
122
122'
123
130
10
121
124
129
121'
10'
1
6
126
14
128
20
13
12
5
2
4
7
8
3
24

HINGES

DETAILED DESCRIPTION

The invention relates to hinges and more particularly to a hinge for articulated connection of two components, especially for articulated pivoting of a furniture door on a furniture body. The hinge is of the two scissor type, crossed, pivot connected articulated arms, of which one arm is pivoted by its one end on the first furniture component and its other end is held by means of a guiding lever system on a fixing bracket which is fastened on the second furniture component, while the other articulated arm is connected by one end, by means of a pivot, with the fixing bracket and its other end is held by means of a lever or sliding guide on that part of the hinge which is fastened on the first furniture component.

Hinges of this kind, which are generally designated also as scissor type hinges, are well known and they are used when it is necessary to ensure that the furniture door can rotate or open by more than 90°.

It is now generally required to achieve a latch effect with such a scissor hinge, i.e. it is necessary to arrange that the door which is guided by this hinge is automatically pressed into the closing position by rotating it from the open position into the closing position at the end of this closing movement is held in this position in such a manner that the door can be opened only after overcoming a certain force.

The purpose of the invention is to form scissor type hinges in such a manner that they have the above-mentioned latch effect and that this latch effect is achieved in a simple manner. In order to solve this problem a scissor type hinge of the kind described above is realised, according to the invention, in such a manner that, in addition to the guide lever, which acts on one articulated arm on the fixing bracket, a spring element is provided which, after overcoming a dead center effect presses the hinge into the closed position and locks it in this position.

In one model of the hinge according to the invention, the spring element acts directly on the guide lever and it consists, for example, of an arcuate and preferably metal leaf spring, one end of which is pivoted on the fixing bracket or on one of the articulated arms; the other end of the leaf spring is connected by a pivot joint to the guide lever. This pivot point on the guide lever in this case is located between the ends of the guide lever, by means of which the lever is connected with the fixing bracket or with one articulated arm. Instead of an arcuate leaf spring, a compression spring element or a similarly acting elastic body, e.g. one which is made from rubber, can also be used as a spring element; this element or a number of these elements can be accommodated within a bearing unit. In this case one end of the spring element is preferably held by means of a pin and slot connection on the fixing bracket or on one articulated arm.

It is also possible that the spring element can be fastened on the guide lever so that the spring element can rotate and/or slide, in which case the spring element is arranged closely adjacent to the latch cam which is arranged on the fixing bracket or on one articulated arm. In another feasible model of the hinge according to the invention the spring element is fastened at one end by means of a pin and slot guide on the guide lever and it is connected by its other end by means of a pivot joint with the fixing bracket or with one articulated arm. By arranging the pin and slot guide on the connection point between the spring element and guide lever it becomes possible in particular to reduce appreciably the length of the fixing bracket which is to be fastened on the other building component or on the furniture side wall.

In this model of the hinge according to the invention, the spring element consists preferably of, for example, a plastics guide block with a compression spring which is arranged within this guide block. This compression spring acts on a pin which is guided so that it can slide in the guide block and this pin preferably acts in conjunction with the slot of the guide lever. In this case the guide block has for example two parallel guiding surfaces which are arranged a certain distance apart; the guiding surfaces are connected to each other on both sides of the guide block by means of a wall section, into which a sliding body which is also made preferably from plastics is then arranged between the guiding surfaces; this compression spring is connected to a pin, for example, a pin which acts together with the slot of the guide lever. Such a spring element has the advantage that it applies the required spring force with unreduced performance over an unlimited number of opening and closing movements of the hinge and it does not lose efficiency due to aging and wear phenomena (due to fracture of the spring components etc.). On using this type of spring element the compression spring can be fitted in the fully released condition into the guide block; this makes fitting especially simple for the assembly of the spring element as well as for the fitting of this element into the hinge.

In a further model of the hinge according to the invention the latch effect is achieved by means of an integral spring element which is provided on the fixing bracket and which is made from plastic and which acts together with one articulated arm; the spring effect of this spring element is based on the inherent elasticity of the plastics material. This spring element is inexpensive to manufacture and it is readily fitted on the hinge so that the production costs for the hinge, in spite of the latch effect which is achieved, are not significantly higher in comparison with the hinges without the latch effect. In addition to the above, the plastic material used for the spring elements ensures that the friction between this spring element and other hinge elements acting together with it is relatively low so that lubricants can be completely eliminated and in spite of the above very low wear is achieved as well as low noise on operating the hinge. The spring element which is made preferably as an arcuate, flat elastic element from a plastic material is, for example, held by one end so that it can pivot on the fixing bracket and its other end is pivoted on that pin which connects the guide lever with one articulated arm.

All the above mentioned models of the hinge according to the present invention have a common feature that the spring element acts either directly on the guide lever, or alternatively on a pin which connects this guide lever with other hinge components, preferably with one articulated arm.

The foregoing and further features of the invention may be more readily understood from the following description of some preferred embodiments thereof, by way of example, with reference to the accompanying drawings, in which:

FIG. 2 is a longitudinal section through the hinge of FIG. 1 in the closed position of the door;

FIG. 3 is a part section through the hinge of FIG. 1 in the open position of the door;

Figure 14:
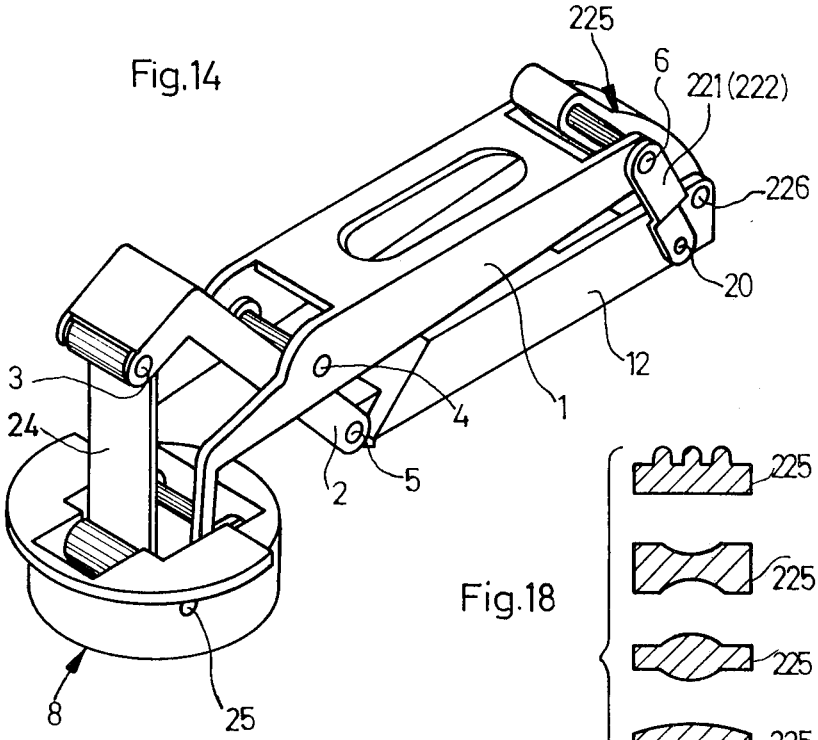
FIG. 14 is a perspective view of an alternative embodiment of a hinge according to the invention with an integral plastic material spring element.
Figure 18:
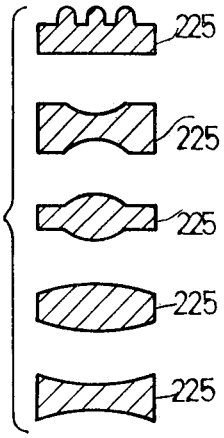
Figure 17:
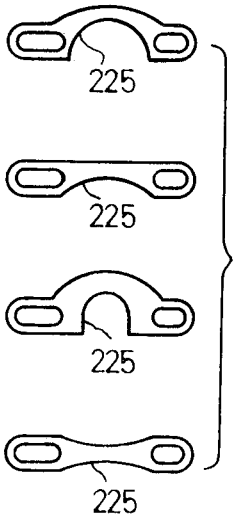
Figure 16:
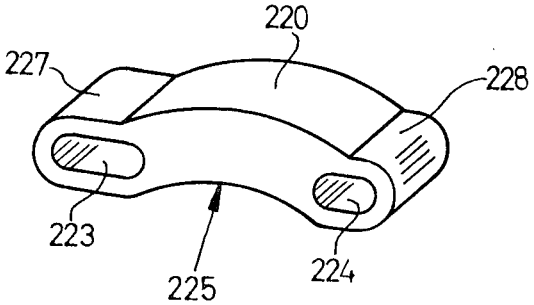
Figure 15:
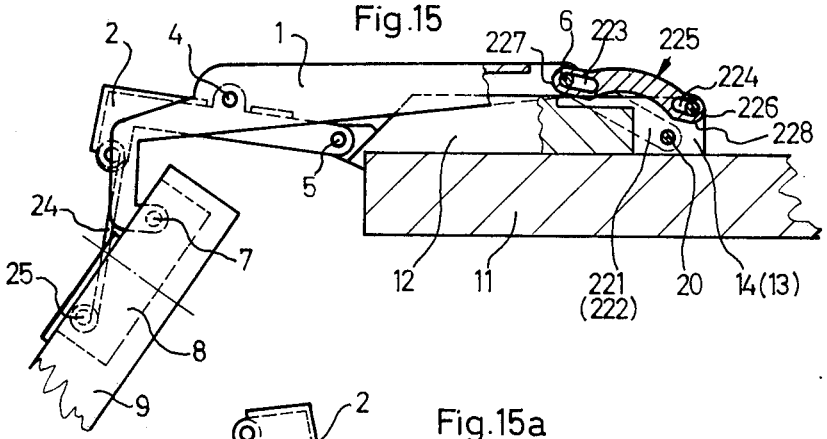
Figure 15A:
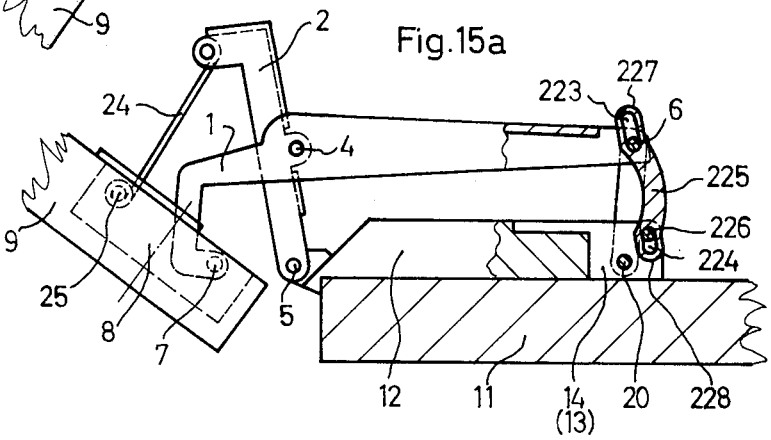
Figure 15B:
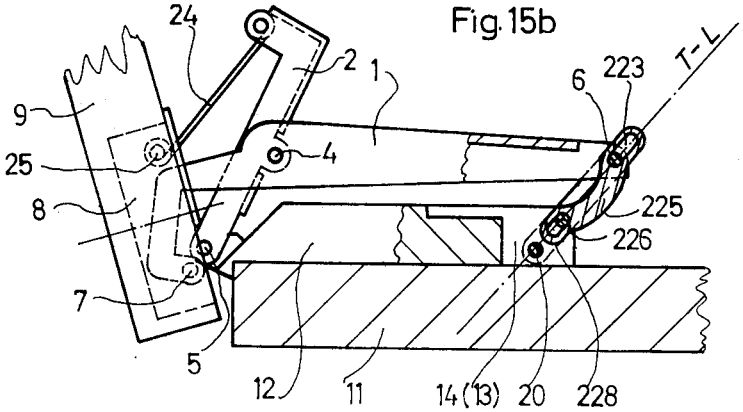

FIGS. 15, 15*a* and 15*b* are side views, part in section of the hinge of FIG. 14 in differennt positions;

FIG. 16 is a perspective view of the spring element of the hinge of FIG. 14, and FIGS. 17 and 18 are different possible designs or cross section forms for the spring element of the hinge of FIG. 14.

Figure 1:
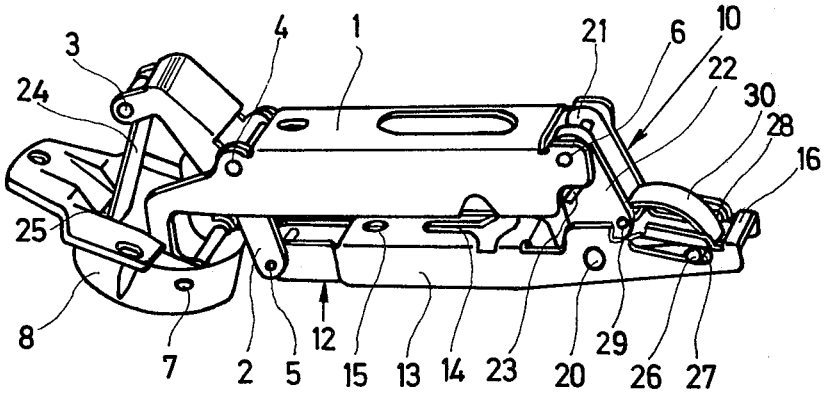
FIG. 1 is a perspective representation of a first embodiment of a hinge according to the invention.

The scissor type hinge shown in FIGS. 1 to 3 consists basically of two crossed articulated arms 1 and 2, which are formed partly as U profiles with side flanges which form the bearing points for the articulated arm pivots 3 to 7. The articulated arm 1 is pivoted by its hook shaped, bent end by means of the pivot pin 7 on a hinge housing 8, which is fixed into a sunk seat in the furniture door 9 which is shown in FIG. 2. The other end of the articulated arm 1 is held by means of a guide lever 10 on a fixing bracket 12 which is fastened on the furniture side wall 11 (FIG. 2). The fixing bracket 12 consists basically of two parallel flanges 13 and 14 which are arranged along the fixing bracket longitudinal axis; these flanges are connected to each other by means of connecting yokes 15 and 16 to form a partly U shaped profile. For holding the fixing bracket 12 on the furniture side wall 11 a mounting plate 18 is provided which is enclosed in a usual manner by the flanges 13 and 14 of the fixing bracket 12 and this mounting plate 18 is fastened on the furniture side wall by its own screws 17; the fixing bracket 12 can be adjusted on this mounting plate 18 by means of a screw 19. The flanges 13 and 14 of the fixing bracket 12 are used as bearing points for the pivot pins 5 and 20 in which the pivot pin 5 represents the pivot point fixed on the furniture for the articulated arm 2 and the pivot pin 20 represents the pivot point for the pivoting connection of one end of the guide lever 10 with the fixing bracket 12. The other end of the guide lever 10 is fastened by means of the pivot pin 6 on the articulated arm 1 so that the guide lever can rotate.

The guide lever 10 consists of two relatively parallel arms 21 and 22, which are used as bearing points for the pivot joints 6 and 20 and which are connected to each other by means of a connecting yoke 23. As shown especially in FIGS. 2 and 3 the two arms 21 and 22 have approximately triangular shape with pivot pins 6 and 20 located on those corner points of each arm which are furthest apart from each other and pivot pin 29 located in the region of the third corner. An arcuate metal leaf spring 30, whose bent and rolled end encloses the pivot pin 29 is arranged between the arms 21 and 22 of the guide lever 10, which is shown especially in FIG. 1 by means of the partial removal of the flange 13. The other bent over end of the leaf spring 30 encloses pivot pin 26, which projects laterally beyond the leaf spring 30 and which is guided in the longitudinal slots 27 and 28 in the flange 13 or 14 of the fixing bracket 12. The slots 27 and 28 are arranged on the end of the fixing bracket 12 which is remote from the furniture door 9, and their distance from this door is greater than that of the pivot joint 20. In addition the slots 27 and 28 are inclined relative to the longitudinal axis of the fixing bracket or relative to the surface of the furniture side wall 11 in such a manner that the distance of the slots from the furniture side wall 11 increases in the direction towards the furniture front side or towards the furniture door 9. The pivot pin 29 is fastened on the guide lever 10 or on its arms 21 and 22 in such a manner that the guide lever 10 is subdivided by this pin 29 into a longer section 6–29 and into a shorter section 29–20. In addition to the above when the door is closed the pivot pin 29 is located on that side of a line connecting the pivot pins 6 and 20 (FIG. 2) which faces the furniture side wall 11, whereas when the door is open the pivot pin 29 is situated on that side of the line connecting 6–20 which is remote from the furniture side wall 11.

On rotating the door 9 from the closed position indicated in FIG. 2 into the open position shown in FIG. 3 the door 9 is initially rotated about the pivot pin 7 on the hook shaped bent end of the articulated arm 1. In this case the articulated arm 2 is rotated at the same time relative to the connecting lever 24, whose one end is connected by means of the pivot pin 3 to the articulated arm 2 and its other end by means of the pivot pin 25 with the hinge housing 8. The articulated arm 2 is rotated about the pivot pin 5 anticlockwise for the representations shown in FIGS. 1 and 2, where the pivot pin 4 which is connected by means of the articulated arm 1 and 2 in the manner of scissors, moves the articulated arm 1 in the direction of the arrow A towards the furniture front side. The lever 10 is used in this case as the rear end guide for the articulated arm 1. On closing the door 9 the articulated arm 1 moves backwards in the direction of the arrow B of FIG. 2 due to a movement of the articulated arm in the clockwise direction.

The characteristic features of the invention are now the additional means for achieving a latch effect in the door closing position. This latch effect is achieved in such a manner that when the door 9 is closed with the associated displacement of the articulated arm 1 in the direction of the arrow B then the guide lever 10 is rotated about the fixing bracket side pivot pin 20 in the direction of the arrow C (FIG. 3). In this case the pin 26 slides from the left hand end of the slots 27 and 28, in which position the pin 26 was situated when the door was open, towards the right hand end of these slots and it reaches this end before the final closing of the door, so that a further closing operation of the door 9 or of the rotating of the guide lever 10 in the direction of the arrow C will lead to an increasing bending of the spring 30 or to additional storing of spring force into this spring, up to the point of time at which the pivot pin 29 moves over the dead center line TL shown in FIG. 3 while the guide lever 10 rotates. The spring 30 in this case is deformed to the maximum extent. On further closing movement of the door 9 or on further rotation of the guide lever 10 in the direction of the arrow C the distance between the right hand end of the slots 27 and 28 as well as of the pivot pin 29 is once again slightly increased, so that the spring 30, by releasing some of the stored spring energy, will move the guide lever 10 away from it in the direction of the arrow C and hence it moves the door 9 under the latch effect into the final closed position, over the articulated arm 1 and together with the articulated arm 2 which is connected with the latter. In this case the hinge parts will assume the position indicated in FIG. 2.

The hinge model according to FIGS. 4 to 8 differs from the above hinge according to FIGS. 1 to 3 only by the different shape of the spring element. For this reason FIGS. 4 to 8 show only that end of the articulated arm 1 and of the fixing bracket 12 which is facing away from the furniture door 9 together with the guide lever and spring elements used there.

Figure 4:
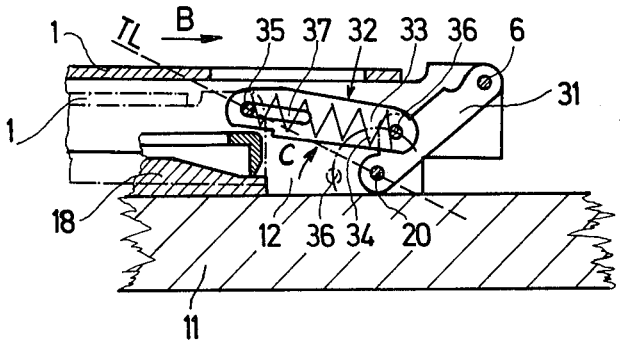
FIGS. 4–8 are part sections through further embodiments of a hinge according to the invention with different forms and arrangements of the spring element.

FIG. 4 shows an embodiment of the scissor type hinge according to the invention, in which the end of the articulated arm 1 which faces away from the furniture door is designated by 31. The guide lever 31 is once again held at one end by means of the pivot pin 20 so that it can rotate on the fixing bracket 12 and its other end is held by means of the pivot pin 6 so that it can rotate on the articulated arm 1. The spring element is in general designated with the number 32 and consists of a tubular or cylindrical guide block 33, within which is accommodated a compression spring 34; this compression spring is arranged, together with its left hand end shown in FIG. 4 which faces the furniture door, and it is in contact with the pivot pin 35, which connects the spring element 32 with the articulated arm 1. The right hand end of the spring 34 is arranged against the wall of the guide block 34 or against a pivot pin 36, which connects the spring element 32 with the guide lever 31. The guide block 33 has a slot 37, so that the guide block 33 can slide relative to the pivot pin 35 or relative to the articulated arm 1 against the force of the compression spring 34. Instead of the compression spring 34, a similarly acting element, for example an elastic rubber unit, can also be used.

When the door is open the articulated arm and hence also the pivot pin 36 will assume the position which is indicated with dash-dot lines, in which the pivot pin 36 is situated on that side of the dead centre line TL passing through the pivot pins 20 and 35 which faces the furniture side wall 11. If the door, which is not indicated in FIG. 4 in detail, is now rotated into the closed position, then the articulated arm slides in the direction of the arrow B, which causes the guide lever 31 and the pivot pin 36 to rotate in the direction of the arrow C about the pivot pin 20 in a clockwise direction. This reduces initially the distance between the pivot pins 35 and 36 so that the guide block 33 is displaced relative to the pivot pin 35, while the spring 34 is compressed in such a manner that the right hand end of the slot 37 approaches the pivot pin 35 and hence the spring 34 is loaded. If, on rotating the guide lever 31 above the pivot pin 20, the pivot pin 36 has reached the dead centre line TL, then the spring 34, owing to the minimum distance which is now established between the pivot pin 35 and 36, reaches its maximum spring force. On further rotation of the guide lever 31 or on further closing of the door the distance between the pivot pins 35 and 36 is increased so that the spring 34 is released and the guide lever 31 is pushed into the position indicated with full lines in FIG. 4, into which the door is rotated in the final closed position by means of the articulated arm 1 automatically under the latch effect. The pivot pin 36 in the scissor type hinge according to FIG. 4 is located on that side of the connection line between the pivot pin 6 and 20 which faces away from the furniture side wall 11; this arrangement differs from the models according to FIGS. 1 to 3, in which the pivot pin 35 of the door side end of the articulated arm 1 is nearer than the pivot pin 20.

Figure 5:
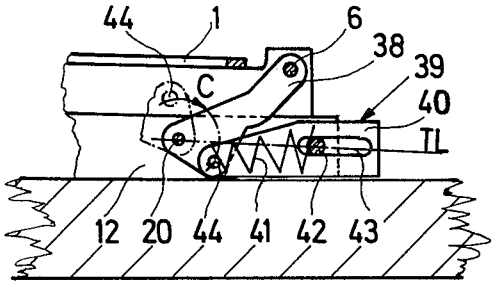

FIG. 5 shows a similar scissor type hinge arrangement, in which a guide lever 38 is connected by means of pivot pins 20 and 6 with the fixing bracket 12 or with the articulated arm 1. The position of the hinge components which are represented in FIG. 5 by solid continuous lines indicates once again the closed position of the door. In order to achieve the intended latch effect, a spring element 39, which consists of the guide block 40 as well as of a compression spring 41 which is arranged within this guide block is provided on the fixing bracket 12. The compression spring 41 is arranged by its right hand end which is indicated in FIG. 5 and which is facing away from the door 9 against a pivot pin 42, which is fastened into the fixing bracket 12 (for example on its flanges 13 and 14), and it passes through the slot 43 of the guide block 40. The left hand end of the compression spring 41 shown in FIG. 5 rests against the inner wall of the guide block 40 or against a pivot pin 44, which connects the spring element 39 with the guide lever 38 and which is arranged to be so that it is laterally displaced on the guide lever 38 relative to the connection line between the pivot pins 6 and 20.

The position of the guide lever 38 as well as of the pivot pin 44 is indicated with a dot-dash line for the open position of the door, from which the guide lever 38 or its pivot pin 44 will rotate in a clockwise direction indicated by the arrow C about the pivot pin 20 on closing the door. In this case the guide block 40 is moved, constrained by the slot 43, relative to the pivot pin 42 or relative to the fixing bracket 12 initially in such a manner that the spring 41 is compressed and its maximum compression condition is achieved when the dead centre line TL has been reached; this corresponds to the minimum distance which occurs there between the pivot lines 42 and 44. On further closing movement of the door the pivot pin 44 travels beyond the dead center line TL, which causes an increase in the distance between the pivot pins 42 and 44 once again and the the spring will partly release its stored spring energy for achieving the latch effect. As in the model according to FIGS. 1 to 3, the connection point 42 of the spring element 30 and of the fixing bracket 12 lies further away from the door side end of this fixing bracket than the pivot pin 20, which is also the case for the model shown in FIG. 5.

Figure 6:
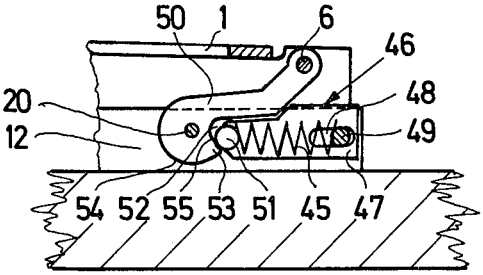

An embodiment similar to that in FIG. 5 is shown in FIG. 6, in which the latch effect is also achieved by a sliding spring element 46 which is held on the fixing bracket 12 against the force of a compression spring 45; this spring element 46 consists of a guide block 47 with slot 48 and the guide block encloses the spring 45. A pivot pin 49 which is fastened on the fixing bracket 12 projects through the slot 48. The end of the guide block 47, which faces the guide lever 50, has a rounded surface 51, which can be formed, for example, by a ball or roller which is connected with the guide block 47. The lever 50 is provided with a curved notch 52 within the region of its end which encloses the pivot pin 20 or within the region of the head in order to achieve the latch effect; the curved notch 52 is arranged in such a manner that the section of the lever 50, which is arranged almost parallel to the fixing bracket longitudinal axis when the door is closed, projects into the notch 52 and when the door is closed, the notch is arranged on that side of the lever 50 which faces the furniture side wall.

The rounded surface 51 slides on opening of the door and when the lever 50, which is connected to the door, is rotated anticlockwise about the pivot pin 20, together with simultaneous displacement of the spring element 46, against the force of the spring 45 towards the right hand side, over the lug 53 on to the circular surface 54 of the lever 50 which is arranged concentrically to the pivot pin 20, so that the spring 45 is loaded. When the door is closed, then the lever 50 rotates clockwise about the pivot pin 20, until finally the rounded surface 51 enters into the notch 52 and the spring element 46 which lies by its rounded surface 51 against the inclined plane 55 of the notch 52, guides the hinge, by the latch effect into the closed position or locks it into this position.

Figure 7:
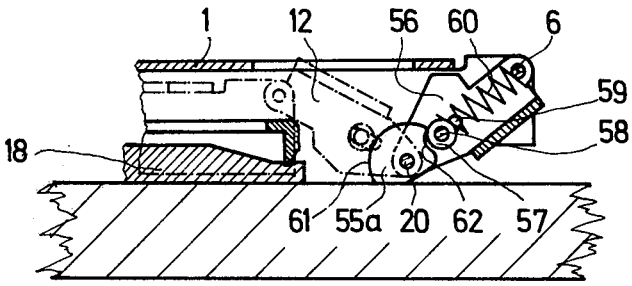
Figure 8:
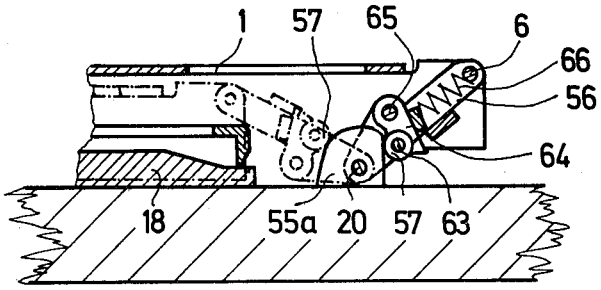

In the embodiment in FIGS. 7 and 8, the latch effect is achieved by means of a latching cam 55*a* which is provided on the fixing bracket 12. The cam contacts a surface, for example a roller 57 or a pin, a sliding and/or rotating spring element 60, 57 which is held on the guide lever 56.

In the embodiment shown in FIG. 7, the spring element consists mainly of the roller 57, which is supported on a pin 58. The pin 58 projects laterally beyond the roller and it is guided in slots 59 in the arms of the guide lever 56 which has a U profile shape. The roller 57 is pressed against the latching cam 55a by a spring 60. In FIG. 7 the open position of the hinge is again shown by means of dash-dot lines and the roller 57 rests against the latching cam section 61 with a larger radius and when the door is closed, it slides directly before the closing position into the latching cam section 62, whose distance from the pivot pin 20 is smaller, so that the door is guided by the latch effect into the closed position and it is locked there.

In the embodiment shown in FIG. 8 the slot 59 in the guide lever 56 is replaced by an arrangement so that the roller 57 is fastened by means of a pin 63 on an auxiliary lever 64, which then in turn is connected by means of a pivot pin 65 to the guide lever 56. A spring 66 tends to rotate the auxiliary lever 64 in the clockwise direction and hence it pushes the roller 57 flexibly against the latching cam 55*a*. Otherwise the hinge shown in FIG. 8 corresponds to the embodiment described in conjunction with FIG. 7.

A further embodiment of the hinge according to the invention is shown in FIGS. 9 to 13. This embodiment differs from the hinges of FIGS. 1 to 3 by different arrangements of the guide lever as well as by the spring element which is pushed into this guide lever.

The guide lever 10 consists once again of two parallel arms or of individual levers 121 and 122, which are used as bearing points for the pivot pins 6 and 20 and which are connected to each other by means of a connecting yoke 123. A respective slot 124, 125 is provided in the arms 121 and 122 of the guide lever through which projects one end of a pin 127 which is held in the spring element 126 in order to achieve a pin- slot connection between the guide lever 10 and the spring element 126. The slots 124 and 125 are arranged, in the model indicated in the Figures, at a sloping angle to the connection line between the pivot pins 6 and 20 and they are also arranged laterally away from the connection line in such a manner that, when the door is open, (cf. FIG. 13) the slots 124 and 125 are arranged on that side of the connection line between the pivot pins 20 and 6 which faces away from the furniture side wall 11 and in the case of the closed door (cf. FIG. 12) they are arranged on that side of this connection line which faces the furniture side wall 11.

Figures 9, 10, 11:
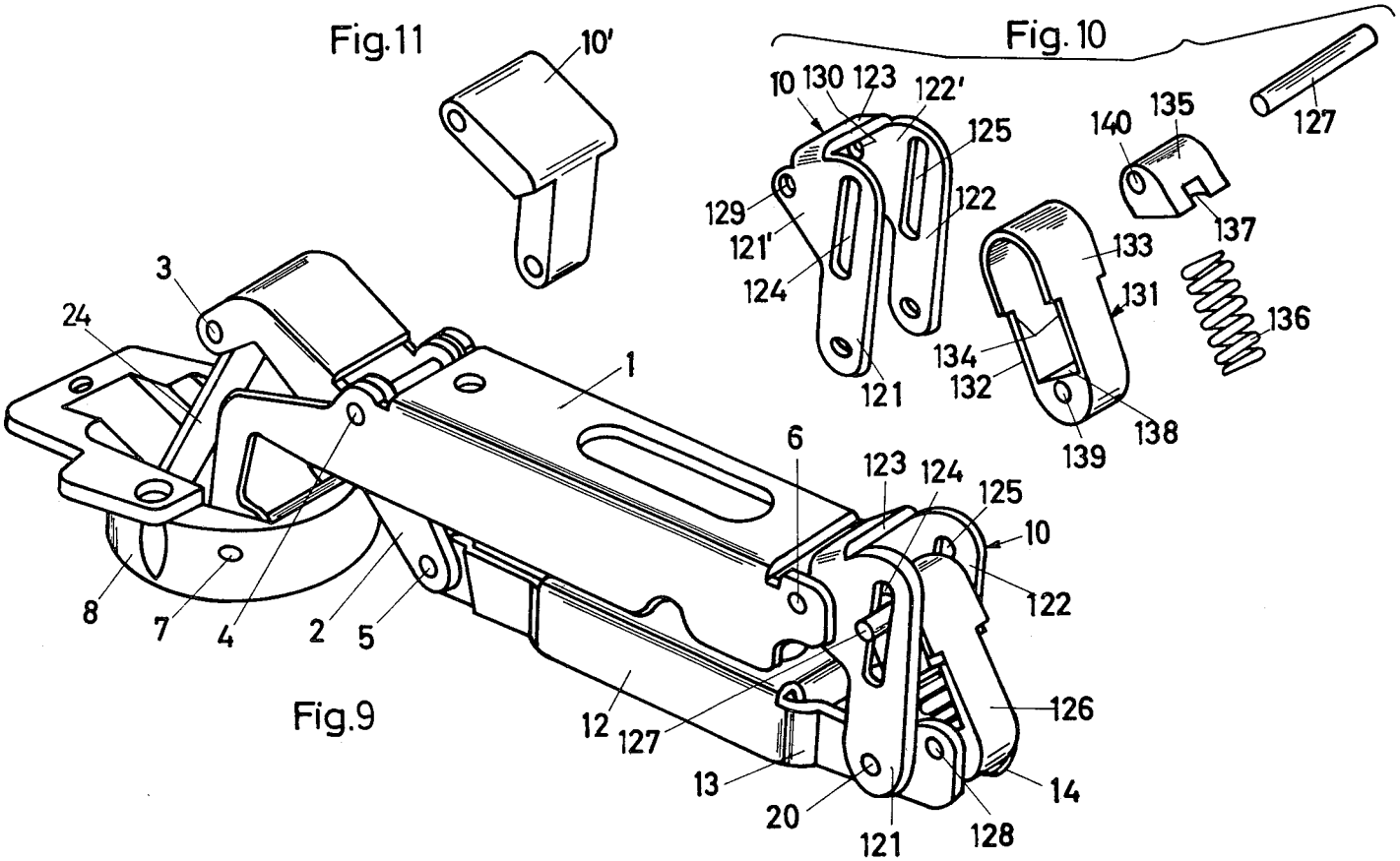
FIG. 9 is a perspective representation of a further embodiment of a hinge according to the invention.
FIG. 10 is a perspective detailed view of a guide lever and a spring element in the dismantled state for use in the hinge of FIG. 9.
FIG. 11 is a perspective view of an alternative guide lever for example for use instead of the guiding lever of FIG. 10.
Figure 12:
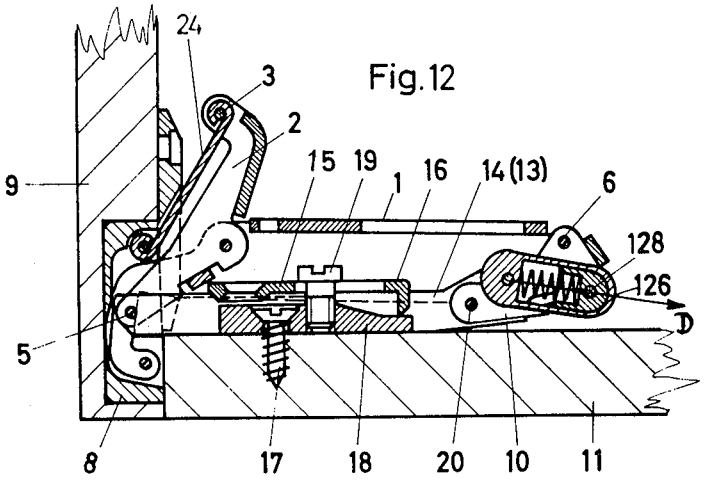
FIG. 12 is a longitudinal section through the hinge of FIG. 9 in the closed position of the door.

The spring element 126 is fastened by its end furthest from the pivot pin 127 by means of the pivot pin 128, on the fixing bracket 12 or on its flanges 13 and 14. The pivot pin 128 in this case is displaced relative to the pivot pin 20 for the guide lever 10 in such a manner that the pivot pin 20 is nearer to the door side end, i.e. to the end of the fixing component 12 which is provided with the pivot pin 5, and the furniture side wall 11 lies nearer than the pivot pin 128. As shown in particular in FIG. 10, the two individual levers or the arms 121 and 122 of the guide lever 10 consist of a long slender bracket shaped part, which has at one end a triangular, laterally projecting lug 121' or 122', which is provided with a hole 129 or 130 for the pivot pin 6. The slot 124 or 125 is located in the region of the triangular projecting lug 121' or 122', i.e. at that location where the lug is formed on the long slender bracket. The extension of the slot 124 or 125 forms an angle of about 25° with the connection line between the pivot points or with pivot pins 6 and 20. As shown in FIG. 10 the spring element 126 which projects into the space between the arms 121 and 122 of the guide lever 10 consists of a preferably plastic guide block 131, whose side is open and which has two guiding surfaces 132 and 133 which are arranged in parallel with a distance between them; the guiding surfaces are connected to each other at the end of the guide block at least on the outer side by means of circular wall sections. Within the space 134 between the guiding surfaces 132 and 133 is arranged a sliding block 137 which can slide against the force of the spring 136. The spring 136 and its upper end, which is shown in FIG. 10, is accommodated by means of an opening 137 into the sliding block 135 and its lower end rests against the lower lateral boundary surface 138 of the guide block 131. In the immediate vicinity of the contacting surface 138 a bore 139 for the pivot pin 128 is provided within the guide block 131.

The sliding block 135 is provided with a bore 140 for accommodating the pivot pin 127. When the compression spring 136 is released then the sliding block 135 rests against the upper, inner boundary surface of the space 134 formed by the guiding surfaces 132 and 133 of the guide block 131 and on compressing the spring 136 it can be moved in the direction towards the lower contact surface 138. The length of the spring 136 is selected in such a manner that the sliding block 135, together with the spring 136 which is pushed into the opening 137, can be inserted into the space 134 with a light pressure fit which facilitates fitting.

Figure 13:
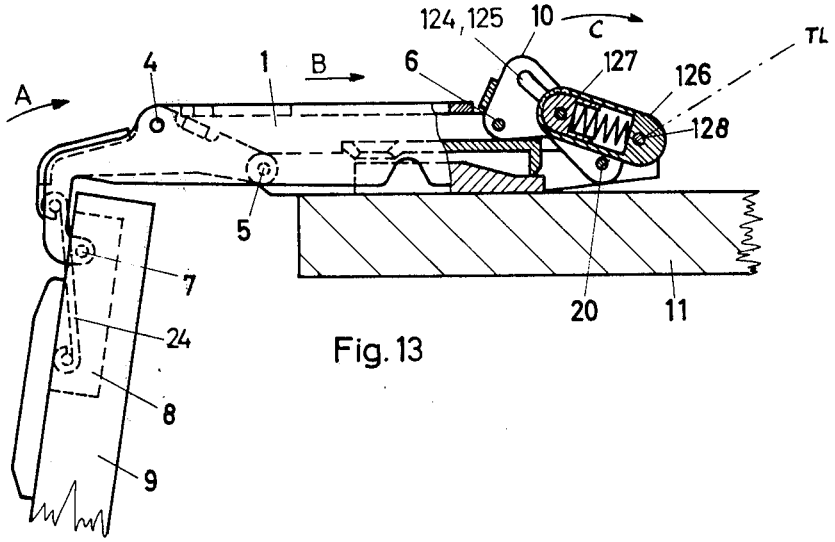
FIG. 13 is a longitudinal section through the hinge of FIG. 9 in the open position of the door.

The mode of section of this hinge according to the invention which is shown in FIGS. 9–13, can be described as below:

When the furniture door 9 is moved away from the open position indicated in FIG. 13 in the direction of the arrow A into the closed position indicated in FIG. 12, then once again the articulated arm 1 slides in the direction of the arrow B in FIG. 13 by means of which the guide lever 10 is rotated in a clockwise direction, i.e. in the direction of the arrow C of FIG. 13 about the fixing bracket side pivot pin 20. In this case the pivot pin 127 of the spring element 131 slides initially freely in the slots 124 and 125, until the pivot pin 127 contacts the upper end of the slots 124 and 125 shown in FIG. 13, which occurs in the embodiments of the hinge according to the invention shown in FIGS. 9–13 for a door opening angle of less than 90°. That rotating angle range of the hinge within which the spring element 126 is no longer effective can be adjusted by means of the lengths of the slots 124 and 125.

If the pivot pin 127 now rests against the upper end of the slots 124 and 125 shown in FIG. 13 and if the door is rotated further in the direction of the arrow A, then the spring 136 is increasingly compressed by the movement of the guide lever 10 in the direction of the arrow C as well as by the displacement of the sliding block 135 within the guide block 131, until, owing to the rotation of the guide lever 10, the pivot pin 127 intersects the dead center line TL shown in FIG. 13; this dead center line passes through the pivot pins 20 and 128 and the spring 136 has in this case its maximum compression i.e. the maximum spring energy storage. On further rotation of the door the pivot pin 127 travels beyond the dead center line TL in the clockwise direction and the spring 136 can then once again be partly released, by means of which a spring force is exerted in the directon of the arrow D of FIG. 12 on the guide lever 10 and hence the lever 10 is rotated about the pivot pin 20 into the position indicated in FIG. 12 and the furniture door is pushed by means of the articulated arms 1 and 2 via the connection lever 24 automatically into the closed position.

FIGS. 14–18 show a further, particularly simple embodiment of the hinge according to the invention. This embodiment differs from the hinge described above by means of FIG. 1–3 only by different design of the guide lever and of the spring element.

In the case of the hinge shown in FIGS. 14 to 18 the guide lever consists of the two individual levers 221 and 222, which are pivoted by means of pivot pins 6 or 20 at one end laterally on the articulated arm 1 and on the fixing bracket 12.

As especially shown in FIG. 14, a curved, flat spring element 225 which is made from synthetic plastic is situated between the individual levers 221 and 222, as well as between the flanges of the articulated arm 1; one end of this spring element projects into an opening of the fixing bracket 12 and it is held there and pivoted by means of the pivot pin 226. The other end of the spring element 225 encloses the pivot pin 6 for the individual levers 221 and 222 and it is fastened on these and pivoted by means of this pivot pin 6.

In order to ensure that the spring element 225 can rotate the hinge into the closed position by travelling beyond the dead center line, it is important that the pivot pin 226, with reference to the furniture side wall 11 or to its surface, is displaced relatived to the pivot pin 20 parallel to the surface of the furniture slide wall 11 and/or at right angles to this surface. This ensures that when the door 9 is rotated and due to consequent sliding of the articulated arm 1 along the furniture side wall 11 the distance between the pivot pins 6 and 226, e.g. during the door closing process, will be initially reduced (FIG. 15*a*) and after that, at the end of the door closing movement, i.e. after the dead center line TL shown in FIG. 15*b* has been exceeded by the pivot pin 6, it will be once again increased. Owing to the change of the distance between the pivot pins 6 and 126 there also follows in the case of this embodiment of the hinge, on closing of the door, a loading of the spring element 225 due to more marked bending of this element up to the dead centre line TL and after the exceeding of this line a partial release of the spring element 225 takes place by means of which the door 9 is then pushed by the force of the spring element into the closed position.

It can be seen further from FIGS. 15, 15*a* and 15*b*, which show the hinge in different rotation positions of the door 9, that the slots 223 and 224, which are provided at the end of the spring element 225 for accommodating the pivot pins 6 or 226, ensure that the door 9 can be initially rotated from the open position shown in FIG. 15 into the position shown in FIG. 15*a*, without activating the spring element 225.

As shown especially in FIG. 16 the flat spring element 225 made from plastic has a circular arcuate cross section 220, on whose ends are formed connecting lugs 227 and 228, which are arranged parallel to a tangent to the center of the circular arcuate cross section 220. The slots 223 and 224 are also arranged into the projecting lugs 227 and 228. An especially good spring action for the spring element 225, preferably made from PVC plastic, is achieved by arranging the projeecting lugs 227 and 228 parallel to an imaginary tangent to the center point of the circular arcuate section 220. The spring element 225 in the form shown in FIG. 16 has a constant thickness over its whole extent, also including the projecting lugs 227 and 228. This constant thickness, is, however, not a necessary condition for the functional capability of the spring element 225; special spring characteristics can be achieved in general by specific cross section forms, such as those shown as examples in FIG. 18, or by partial weakening and reinforcement. Moreover, it is also not necessary for the middle section of the spring element 225 to have a circular arcuate form. In this area, depending on the needs, any possible required spring characteristics can also be achieved by curvatures with different thicknesses. A few of the possible forms of the spring elements 225 are shown in FIGS. 17 and 18.

On considering the embodiments of the hinge according to the inventions which are shown in the Figures it is especially advantaeous that the guide lever or the individual lever 221 as well as 222 can be replaced at any time without difficulties by the guide lever 10 shown in FIG. 11 and by eliminating the spring element, if a hinge without latch effect is required. This possibility considerably simplifies production and storage especially for the manaufacturer of the hinge.

What we claim is:

1. A scissor hinge for articulated connection of two components, said hinge comprising (a) a fixing bracket having means operable to fix said hinge to one of the components; (b) a guide lever pivotably mounted at one end to said fixing bracket in the area of a first end of said bracket; (c) two crossed and pivotably joined hinge arms, a first end of the first of said hinge arms being pivotably mounted on said fixing bracket and a first end of the second of said hinge arms being pivotably joined to the second end of said guide lever; (d) fitting means articulately connected to the second ends of said first and second hinge arms and having means operable to fix said fitting means to the second of the components; and (e) spring means operable to urge said hinge to a fully open or fully closed position.

2. A hinge according to calim 1 wherein the second end of the second hinge arm is pivotably connected to the fitting means and the second end of the first hinge arm is articulately connected to the fitting means through a connecting lever, one end of said lever being pivotably connected to said first hinge arm and a second end of said lever being pivotably mounted on said fitting means.

3. A hinge according to claim 2 wherein the second end of said second hinge arm is pivotably connected to said fitting means and said fitting means includes means operable to slidably connect the second end of said first hinge arm to said fitting means.

4. A hinge according to claim 2 wherein said spring means act directly on said guide lever.

5. A hinge according to claim 4 wherein one end of said spring means acts on said guide lever and the other end of said spring means is linked to either said fixing bracket or said second hinge arm for slidable displacement.

6. A hinge according to claim 5 wherein said spring means is pivotably mounted on said guide lever between the points at which said guide lever is pivotably mounted on said fixing bracket and pivotably joined to said second hinge arm.

7. A hinge according to claim 6 wherein the point at which said spring means is pivotably mounted on the guide lever divides said lever into two sections of unequal lengths.

8. A hinge according to claim 7 wherein the shorter of said two sections is adjacent to said fixing bracket.

9. A hinge according to claim 5 wherein said spring means is linked to said fixing bracket or to said second hinge arm through a pin-slot connection.

10. A hinge according to claim 5 wherein said guide lever is pivotably mounted on said fixing bracket at a position on said fixing bracket more distant from said fitting means than is the point at which said spring means is linked to said fixing bracket.

11. A hinge according to claim 5 wherein said spring means is linked to said fixing bracket at a position on said fixing bracket more distant from said fitting means than the point at which said guide lever is pivotably mounted on said fixing bracket.

12. A hinge according to claim 5 wherein said spring means is pivotably mounted on said guide lever, which point is displaced to that side of the line connecting the points at which the guide lever is pivotably mounted on said fixing bracket and pivotably joined to said second hinge arm which is nearer to said fixing bracket when said hinge is open and more distant from said fixing bracket when said hinge is closed.

13. A hinge according to claim 5 wherein said guide lever includes two parallel faces and at least one connecting yoke, the bearings for said pivotable connections to said layer being defined in said parallel faces.

14. A hinge according to claim 13 wherein said spring means is disposed at least partially in the space defined between said parallel faces.

15. A hinge according to claim 4 wherein said spring means is an arcuate leaf spring.

16. A hinge according to claim 4 wherein said spring means comprises an elastic material.

17. A hinge according to claim 4 wherein said spring means includes a compression spring.

18. A hinge according to claim 17 wherein said spring means includes a guide block for guiding said compression spring.

19. A hinge according to claim 18 wherein said guide block is linked to said fixing bracket or said second hinge through a pin-slot connection.

20. A hinge according to claim 4 wherein the end of said spring means acting on said guide lever includes a pivot pin and said guide lever is provided with a slot operable to receive said pivot pin for slidable motion within said slot.

21. A hinge according to claim 20 wherein said slot is laterally displaced from the line connecting the points at which the guide lever is pivotally mounted on the fixing bracket and pivotably joined to said second hinge arm.

22. A hinge according to claim 21 wherein said slot is displaced at an angle of about 25° from said connecting line.

23. A hinge according to claim 21 wherein said slot is disposed on said guide lever on that side of said connecting line which is more distant from said fixing bracket when said hinge is open and which is nearer to said fixing bracket when said hinge is closed.

24. A hinge according to claim 23 wherein said spring means includes a compression spring and a guide block for guiding said compression spring.

25. A hinge according to claim 24 wherein said guide block is hollow and a sliding pin member is disposed for sliding movement within said guide block, said pin member being urged to an extreme position within said guide block by said spring and said pin member further having pin means extending beyond said guide block for engagement by said slots of said guide lever.

26. A hinge according to claim 25 wherein the interior of said guide block has two parallel interior walls for sliding engagement of said pin member, a first thickened end wall, said thickened end wall operable to receive one end of said spring and a second end wall the surface of which complements the exterior surface of said pin member, said spring being disposed between said first end wall and said pin member and said first end wall including means for pivotably mounting said guide block to said fixing bracket.

27. A hinge according to claim 1 wherein said spring means is an integral resilient plastic element acting on said fixing bracket and one of said hinge arms.

28. A hinge according to claim 27 wherein the spring means is an arcuate, flat plastic element.

29. A hinge according to claim 27 wherein one end of said spring means is disposed on the pivotable connection of said guide lever and said second hinge arm, and the other end of the spring element is disposed on said fixing bracket by means of a pivot pin.

30. A hinge according to claim 29 wherein the spring means has a slot at each end serving as a bore operable to receive a pivot pin.

31. A hinge according to claim 29 wherein the spring means has a circular arc shaped section with continuous projecting lugs, said lugs lying on the line secant to the circular section.

32. A hinge according to claim 28 wherein the spring means has sections of different strengths.

33. A hinge according to claim 28 wherein the spring means has a non-rectangular cross section.

34. A hinge according to claim 33 wherein the spring means has longitudinal ribs on at least one side.

* * * * *